US007163595B2

(12) United States Patent
Watson

(10) Patent No.: US 7,163,595 B2
(45) **Date of Patent: *Jan. 16, 2007**

(54) THERMAL PROCESS FOR TREATING METALS TO IMPROVE STRUCTURAL CHARACTERISTICS

(75) Inventor: Daniel Watson, 350 Jennifer La., Driftwood, TX (US) 78619

(73) Assignee: Daniel Watson, Driftwood, TX (US)

( * ) Notice: Subject to any disclaimer, the term of this patent is extended or adjusted under 35 U.S.C. 154(b) by 195 days.

This patent is subject to a terminal disclaimer.

(21) Appl. No.: 10/783,932

(22) Filed: Feb. 20, 2004

(65) Prior Publication Data

US 2004/0261917 A1 Dec. 30, 2004

Related U.S. Application Data

(60) Provisional application No. 60/482,029, filed on Jun. 24, 2003.

(51) Int. Cl.
*C21D 6/04* (2006.01)

(52) U.S. Cl. ..... 148/577; 148/578

(58) Field of Classification Search ..... 148/577, 148/578

See application file for complete search history.

(56) References Cited

U.S. PATENT DOCUMENTS 6,544,669 B1 * 4/2003 Groll ..... 428/687

OTHER PUBLICATIONS

William E. Bryson, Cryogenics, 1999, Hanser Gardner Publications, pp. 29, 40, 49-52, 65-75.*

Weisend, Handbook of Cryogenic Engineering, May 6, 1999, Taylor & Francis, 413-428.*

* cited by examiner

*Primary Examiner*—Roy King
*Assistant Examiner*—Michael P. Alexander
(74) *Attorney, Agent, or Firm*—Buskop Law Group PC; Wendy Buskop

(57) ABSTRACT

The thermal process for treating a metal to improve structural characteristics of the metal entails placing a metal within a thermal control apparatus; introducing a cryogenic material into the thermal control apparatus to decrease the metal temperature, while preventing over-stressing of the metal, to a first target temperature ranging from −40 degrees F. and −380 degrees F. at a first temperature rate ranging from 0.25 degrees per minute and 20 degrees per minute; stopping the introduction of the cryogenic material once the first target temperature is reached; increasing the chamber temperature to a second target, temperature ranging from 0 degrees F. and 1400 degrees F.; and increasing the metal temperature to the second target temperature at a second temperature rate ranging from 0.25 degrees per minute and 20 degrees per minute, resulting in a treated metal without fractures.

22 Claims, 3 Drawing Sheets

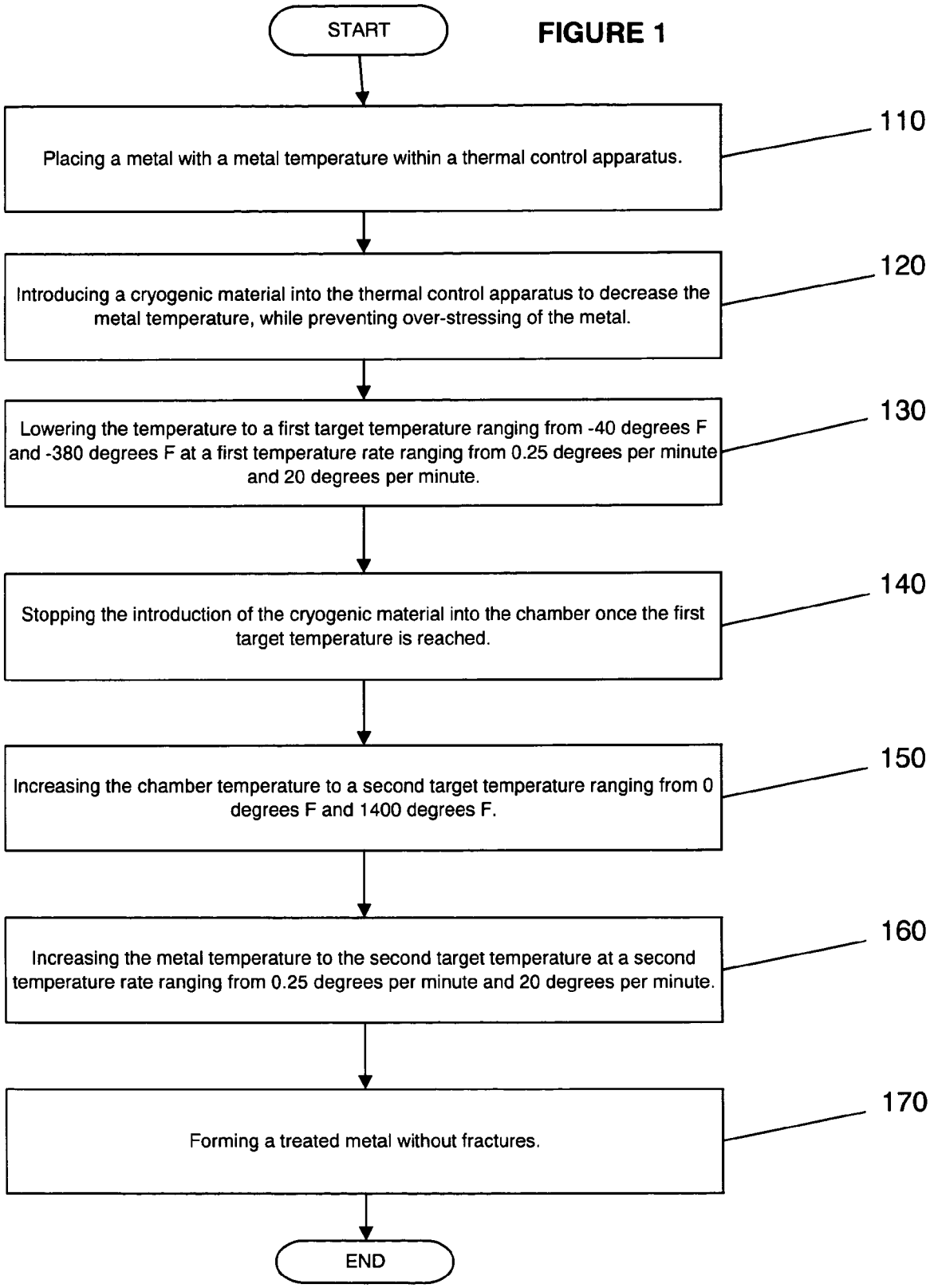
START
FIGURE 1
Placing a metal with a metal temperature within a thermal control apparatus.
110
Introducing a cryogenic material into the thermal control apparatus to decrease the metal temperature, while preventing over-stressing of the metal.
120
Lowering the temperature to a first target temperature ranging from -40 degrees F and -380 degrees F at a first temperature rate ranging from 0.25 degrees per minute and 20 degrees per minute.
130
Stopping the introduction of the cryogenic material into the chamber once the first target temperature is reached.
140
Increasing the chamber temperature to a second target temperature ranging from 0 degrees F and 1400 degrees F.
150
Increasing the metal temperature to the second target temperature at a second temperature rate ranging from 0.25 degrees per minute and 20 degrees per minute.
160
Forming a treated metal without fractures.
170
END

THERMAL PROCESS FOR TREATING METALS TO IMPROVE STRUCTURAL CHARACTERISTICS

The present application claims priority to U.S. Provisional Patent Application Ser. No. 60/482,029 filed on Jun. 24, 2003.

FIELD

The present embodiments relate to thermal processes for treating a metal to improve the structural characteristics.

BACKGROUND

A need exists for a process to treat metals and similar materials of manufacture in order to increase their structural characteristics. For example, in the manufacture of tools and tool components, machinery, engine parts, wear surfaces and like articles from various steels and materials that are used for high wear applications, the common practice is to subject the steel to one or more thermal process treatments, either before or after formation of the steel carbide, so as to modify the properties of at least the exterior of the components. These treatments provide the articles with greater strength, enhanced conductivity, greater toughness, enhanced flexibility, longer wear life, and the like.

A number of thermal type processes are known in the metallurgical arts to enhance the properties of manufacturing materials, such as steels and the like. One widely used class of such metallurgical processes generally known as quenching typically involves forming an article of the desired metal containing material and then rapidly lowering the temperature of the article followed by a return of the article to ambient temperature. The problem with the current processes, controlled or not, is the formation of residual stress in the material. This results in stressing the material and even possibly fracturing the material rendering it useless.

A further enhancement process for manufacturing materials, such as steel, is in the formation of a nitride containing layer on the surface of an article of the metal containing material that hardens the material by forming nitrides such as metal nitrides at or near the surface of an article. The formed nitride surface layer may include extremely hard compounds containing nitrides such as CrN, $Fe_2N$, $Fe_3N$ and $Fe_4N$. The formed nitride layer tends to create compressive stresses that improve the properties of the metal containing material, but can also lead to distortions in the article being treated.

The current art describes single wave processes that concentrate on the cryogenic target temperature and possibly one positive range temperature. The focus of the current art on the cryogenic target temperature does not give any regard to the material being treated. The cryogenic phase causes stresses in the metal and the subsequent heat process also causes stresses the material. The prior art has done little to deal with these secondary stresses.

A need, therefore, exists, for multi-wave thermal treatments in which the target temperatures are dictated by the material being treated.

A need has long existed for a thermal process to treat a metal or article of manufacture to improve its structural characteristics.

SUMMARY

The thermal process is for treating a metal to improve structural characteristics. The metal is placed into a thermal control apparatus. The thermal control apparatus has a chamber, wherein the chamber temperature is closely regulated. The method continues by introducing a cryogenic material into the thermal control apparatus to decrease the metal temperature, while preventing over-stressing of the metal. The metal temperature is decreased to a first target temperature ranging from −40 degrees F. and −380 degrees F. at a first temperature rate ranging from 0.25 degrees per minute and 20 degrees per minute. When the first target temperature is reached, the cryogenic material is no longer introduced into the chamber. The chamber temperature is then increased to a second target temperature ranging from 0 degrees F. and 1400 degrees F. at a second temperature rate ranging from 0.25 degrees per minute and 20 degrees per minute. The result of the process is a treated metal without fractures.

The thermal process also includes repeating the chilling and heating cycle numerous times to obtain the desired metallurgical feature in the fracture-less, treated metal.

BRIEF DESCRIPTION OF THE DRAWINGS

The present embodiments will be explained in greater detail with reference to the appended Figures, in which:

FIG. 1 is a schematic diagram of the steps of the method for treating a drill bit.

Figure 2:
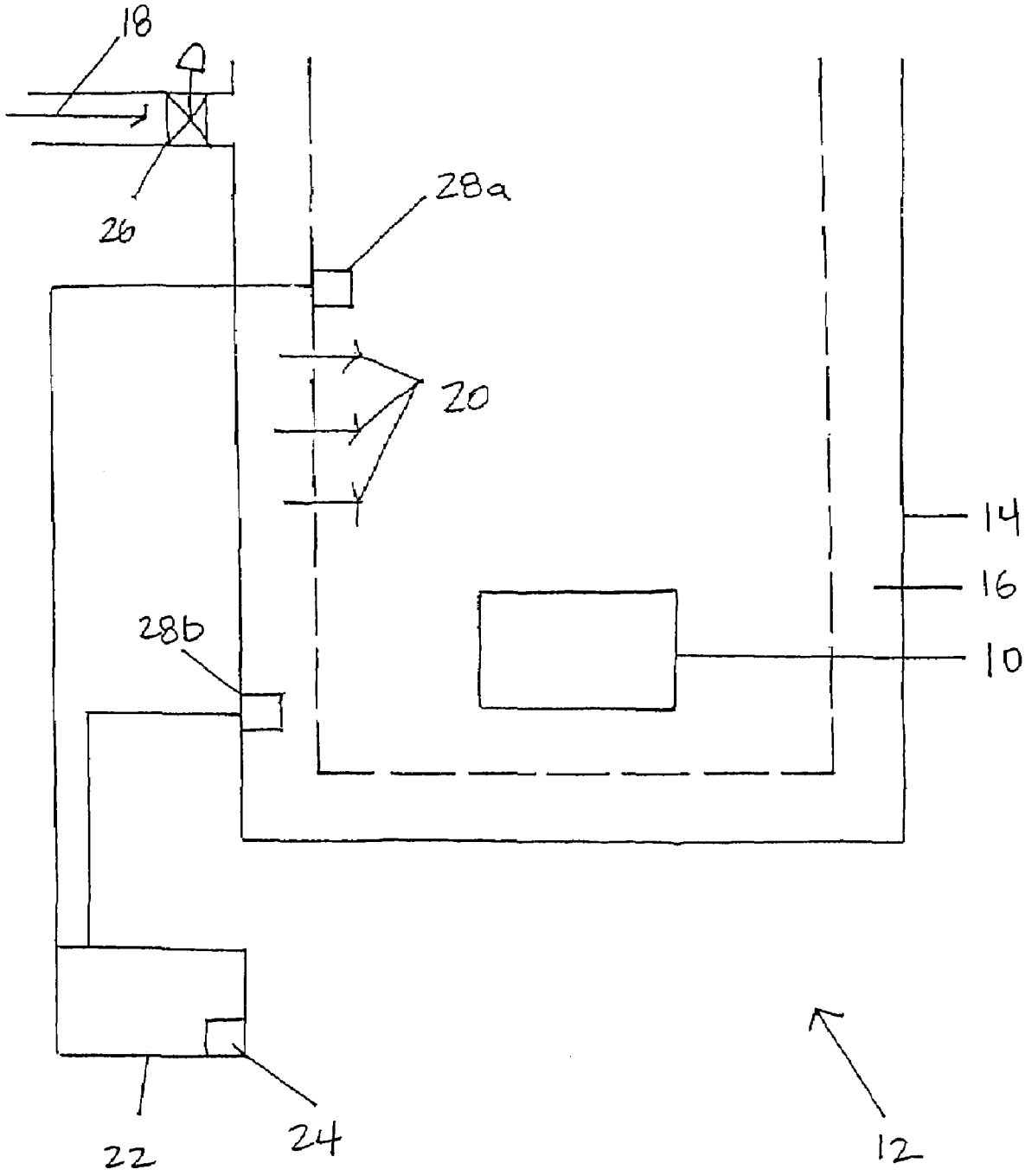
FIG. 2 depicts a detailed cross section of the chamber used in the process.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and can be practiced or carried out in various ways.

The thermal process is a method for treating a metal to improve the structural and metallurgical characteristics of the metal. In a preferred embodiment the term material can be defined as a metal.

FIG 1 provides the steps of the process. The method begins with placing a metal with a metal temperature within a thermal control apparatus (110). The method continues by introducing a cryogenic material into the thermal control apparatus to decrease the carbide temperature, while preventing over-stressing of the metal (120). The temperature is then lowered to a first target temperature ranging from −40 degrees F. and −380 degrees F. at a first temperature rate ranging from 0.25 degrees per minute and 20 degrees per minute (130). The introduction of the cryogenic material can he stopped into the chamber once the first target temperature is reached (140). The chamber temperature to a second target temperature is increased ranging from 0 degrees F. and 1400 degrees F. The metal temperature is increased to the second target temperature at a second temperature rate ranging from 0.25 degrees per minute and 20 degrees per minute (160). The method concludes by forming a treated metal without fractures (170).

FIG 2 shows a cross sectional detail of the thermal control apparatus (12) that comprises a chamber (14). In the embodiment of FIG 2, cryogenic material (18) is introduced to the thermal control apparatus, such as through a valve (18) such that the temperature of the chamber (12) increases or decreases depending on whether the valve is on or off The temperature of the chamber is closely regulated.

Cryogenic material (18) is introduced into the thermal control apparatus (12) in order to decrease the metal temperature. The cryogenic material is added so that the metal is not over-stressed. Over-stressing includes fracturing the metal. The temperature of the metal is decreased to a first target temperature ranging from −40 degrees F. and −380 degrees F. at a first temperature rate ranging from 0.25 degrees per minute and 20 degrees per minute. Once the first target temperature is reached, the cryogenic material (18) is no longer added to the chamber (14).

The thermal control apparatus can further include a heat exchanger (16) located within the chamber to provide a cryogenic vapor (20) to the tank. The cryogenic material (18) is released into the heat exchanger (16) thereby absorbing heat from the chamber into the heat exchanger (16) forming a cryogenic vapor (20) that fills die tank. Examples of cryogenic vapors contemplated in this invention are hydrogen, nitrogen, oxygen, helium, argon, and combinations thereof.

The method continues by increasing the chamber temperature to a second target temperature ranging from 0 F. and 1400 F. The metal temperature is also increased to the second target temperature at a second temperature rate. The second temperature rate ranges from 0.25 degrees per minute and 20 degrees per minute. The result of this first cycle is a treated metal without fractures.

In the preferred embodiment, the first temperature rate is different from the second temperature rate to create a desired metallurgical feature in the treated metal without fractures. Examples of the desired metallurgical features improved using this method include malleability, flexibility, ductility, hardness, elasticity, strength, and combinations thereof The first temperature rate, however, can be substantially the same as the second temperature rate and create a similar effect on the metal.

The invention also contemplates that a second thermal cycle can be applied to the metal. The cryogenic material is introduced, again, into the thermal control apparatus (12) to decrease the metal temperature and prevent over-stressing of the metal. The metal temperature is decreased to a third target temperature at a third temperature rate. In the preferred embodiment, the third target temperature is colder than the first target temperature.

The second cycle continues by stopping the introduction of the cryogenic material (18) into the chamber (14) once the third target temperature is reached. The chamber temperature is then increased to a fourth target temperature. The metal temperature is likewise increased to the fourth target temperature at a fourth temperature rate. The second cycle results in a treated metal without fractures with improved structural and metallurgical characteristics.

In the preferred embodiment, the thermal process comprises three cycles. In the third cycle, the cryogenic material (18) is added to the thermal control apparatus (12) to decrease die metal temperature while preventing over-stressing of the metal. The metal temperature is reduced to a fifth target temperature at a fifth temperature rate. When the fifth target temperature is reached, the cryogenic material (18) is no longer introduced into the chamber (14).

The third cycle continues by increasing the chamber temperature to a sixth target temperature and, thereby, increasing the metal temperature to the sixth target temperature. The temperature increase is done at a sixth temperature rate resulting in a treated metal without fractures and improved structural and metallurgical characteristics.

Figure 3:
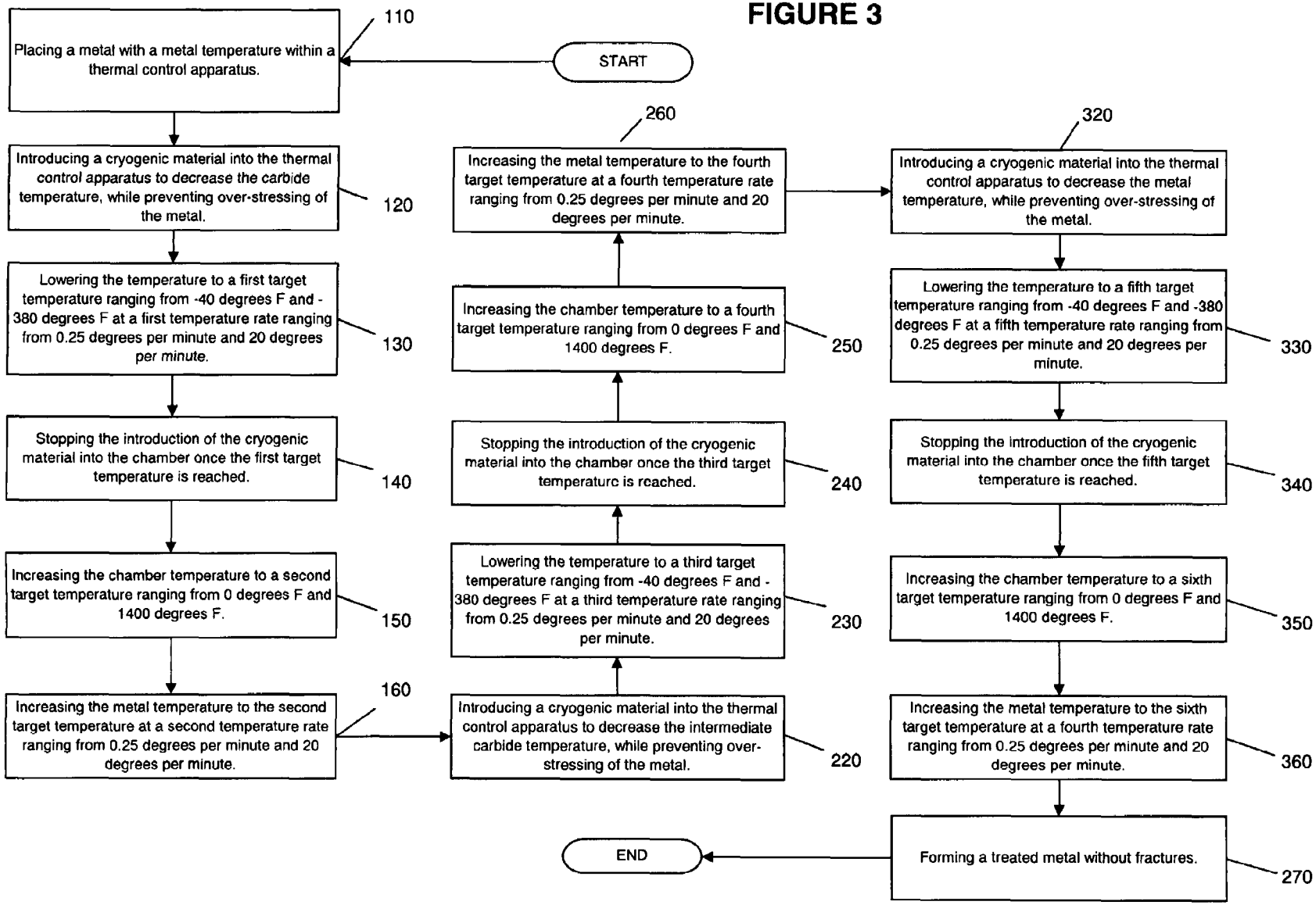
FIG. 3 is a schematic diagram that shows three thermal cycles of the method shown in FIG. 1.

FIG 3 depicts the process of the invention wherein the thermal process includes three thermal cycles resulting in a treated metal without fractures and improved structural and metallurgical characteristics. The method of FIG. 3 begins with placing a metal with a metal temperature within a thermal control apparatus (110). The method continues by introducing a cryogenic material into the thermal control apparatus to decrease the carbide temperature, while preventing over-stressing of the metal (120). The temperature is then lowered to a first target temperature ranging from −40 degrees F. and −380 degrees F. at a first temperature rate ranging from 0.25 degrees per minute and 20 degrees per minute (130). The introduction of the cryogenic material can be stopped into the chamber once the first target temperature is reached (140). The chamber temperature to a second target temperature is increased ranging from 0 degrees F. and 1400 degrees F. The metal temperature is increased to the second target temperature at a second temperature rate ranging from 0.25 degrees per minute and 20 degrees per minute (160). Cryogenic material is then introduced into the thermal control apparatus to decrease the intermediate carbide temperature, while preventing overstressing of the metal (220). The temperature is then lowered to a third target temperature ranging from −40 degrees F. and −380 degrees F. at a third temperature rate ranging from 0.25 degrees per minute and 20 degrees per minute (230). The method will then stop the introduction of the cryogenic material into the chamber once the third target temperature is reached (240). The chamber temperature is increased to a fourth target temperature ranging from 0 degrees F. and 1400 degrees F. The metal temperature to the fourth target temperature is then increased at a fourth temperature rate ranging from 0.25 degrees per minute and 20 degrees per minute. Additional cryogenic material is introduced into the thermal control apparatus to decrease the metal temperature, while preventing over stressing of the metal (320). The temperature to a fifth target temperature is lowered ranging from −40 degrees F. and −380 degrees F. at a fifth temperature rate ranging from 0.25 degrees per minute and 20 degrees per minute (330). The cryogenic material is stopped into the chamber once the fifth target temperature is reached (340). The chamber temperature to a sixth target temperature ranging from 0 degrees F. and 1400 degrees F. is increased (350). The metal temperature to the sixth target temperature is increased at a fourth temperature rate ranging from 0.25 degrees per minute and 20 degrees per minute (360). Finally a treated metal without fractures if formed (270).

The thermal process can further include the step of allowing the metal to soak at the cold temperature for a specific period of time. The period of time for soaking can range from less than 15 minutes to times longer than 96 hours. The preferred aging process for an elevated temperature may be as long as four days to relieve the stress in the metal.

The temperature rates in each cycle are determined by the mass of the metal or other properties of the metal. Basing the temperature ranges and rates on the qualities of the metal relieves stresses, but creates new stress by super-solidification. Super-solidification is the increase in material density and organization due to the decrease of molecular movement in the material during the cryogenic treatment. The method of the invention relieves the stresses created by the cryogenic portion of the treatment in the heat phases that follows the cooling. Through repeated chilling and heating, the molecules are condensed into a more highly organized configuration and relieved of the stresses created therein.

The heat phase temperature range and rate are selected due to the qualities of the metal. Repeated treatments result in this refinement of the molecular structure for the material being treated.

In a preferred embodiment the term material can be defined as a metal. The types of metal contemplated to be used by this process include bronze, cobalt, silver, silver alloy, nickel, nickel alloy, chromium, chromium alloy, vanadium, vanadium alloy, tungsten, tungsten alloy, titanium, titanium alloy, scandium, scandium alloy, tin, platinum, palladium, gold, gold alloy, plated metal, lead, plutonium, uranium, zinc, iron, iron alloy, magnesium, magnesium alloy, gallium, gallium arsenide, selenium, silicon, calcium, calcium fluoride, fused silica materials, germanium, inidium, indium phosphide, phosphorous and combinations thereof. The metal can also be a laminate alone or one disposed on a ceramic, a wood, a polymer, or combinations thereof. The metal can also be a ceramet or a metal carbide.

The most preferred embodiment of the invention is three thermal cycles of cryogenic treatment with a double heat treatment at the end. The first target temperature is known as the shallow chill. The third target temperature is known as the cold chill. A "heat" process" is when the metal temperature is allowed to return to room temperature or anything above 0 degrees F. "Aging" is defined as holding at room temperature for several days or weeks between chills. Aging is also effective when used in combinations with this thermal process.

The following is an example of a three wave or three cycle thermal process.

The first example is for enhancing the strength of steel. The steel is, first, placed in the thermal control apparatus. The temperature of steel is tempered to its appropriate temperature. The cryogenic material is introduced into the thermal control apparatus to lower the temperature of the steel to −120 degrees F. at a rate of 1 degree per minute. This temperature rate and target temperature increases the durability qualities of the steel. The steel is kept at the −120 degrees F. temperature for at least two hours. The steel is then tempered to a second target temperature of 290 degrees F. and maintained at that temperature for at least one hour. The second cycle begins by introducing the cryogenic material into the thermal control apparatus again. The temperature of the steel is lowered to a third target temperature of −300 degrees F. and is maintained at that temperature for at least twenty-four hours. The steel is then tempered to a fourth target temperature of 290 degrees F. and maintained at that temperature for at least one hour. The steel is then subjected to a third thermal cycle wherein the temperature of the steel is lowered to a fifth target temperature of −300 degrees F. and is maintained at that temperature for at least twenty-four hours. Finally, the steel is tempered to a sixth target temperature of 290 degrees F. and maintained at that temperature for at least one hour.

The second example is for increasing the hardness quality of steel. The steel is placed into the thermal control apparatus and is tempered to its appropriate temperature. The cryogenic material is introduced into the thermal control apparatus to lower the temperature of the steel to −120 degrees F. at a rate of 10 degrees per minute. The rapid temperature rate increases the hardness quality of the steel. The steel is maintained at −120 degrees for at least two hours. The steel is then tempered to a second target temperature of 290 degrees F. and maintained at that temperature for at least one hour. The steel is then subjected to two more thermal cycles. In each cycle, the cryogenic material is added to the thermal control apparatus and the temperature of the steel is lowered to a temperature of −300 degrees F. and maintained at that temperature for at least twenty-four hours. Each cycle ends by tempering the steel to a target temperature of 290 degrees F. and maintaining that temperature for at least one hour.

For increasing corrosion resistance in steel, the temperature is changed according to the mass of the steel. The temperature of the steel is lowered to −300 degrees F. and maintained for at least twenty-four hours.

The third example is for weld enhancement, such as in 1080 wire. The wire is tempered to 900 degrees F. and maintained for at least six hours to deaden the weld. The weld is then subjected to a first thermal cycle where the temperature of the weld is reduced to −120 degrees F. and maintained for at least one hour. The weld is then subjected to two more thermal cycles. In each cycle, the cryogenic material is added to the thermal control apparatus and the temperature of the weld is lowered to a temperature of −300 degrees F. and maintained at that temperature for at least twenty-four hours. Each cycle ends by tempering the weld to a target temperature of 290 degrees F. and maintaining that temperature for at least one hour.

For increasing the durability of aluminum, the aluminum is subjected to a slow temperature rate, such as 1 degree per minute. The slow temperature rate promotes the increased durability in the aluminum. The temperature of the aluminum is lowered to −120 degrees F. and maintained at that temperature for at least two hours. The aluminum is then tempered to 120 degrees F. and kept at that temperature for at least two hours.

For increasing the flexibility of aluminum, also know as annealing, the aluminum is subjected to high temperature rate, such as greater than 10 degrees per minute. The temperature of the aluminum is lowered to a temperature of −300 degrees F. and kept at the cold temperature for at least twenty-four hours.

The chamber used in the thermal process can be a double-walled insulated chamber, a vacuum chamber, and a vacuum-insulated chamber. Computer control (22) of the cryogenic process consists of a dedicated microprocessor unit (24) which controls injection of the cryogenic material via a solenoid-operated valve (26). Thermocouples (28*a* and 28*b*) provide real-time temperature measurement, and feedback to the microprocessor, which then follows the programmed temperature targets and rates.

While these embodiments have been described with emphasis on the preferred embodiments, it should be understood that within the scope of the appended claims the embodiments might be practiced other than as specifically described herein.

What is claimed is:

1. A thermal process for treating a material to improve structural characteristics of the material consisting of:

a. placing a material with a material temperature within a thermal control apparatus consisting of a chamber with a chamber temperature;

b. introducing a cryogenic material into the thermal control apparatus to decrease the material temperature, while preventing over-stressing of the metal, to a first target temperature ranging from −120 degrees F. and −380 degrees F. at a first temperature rate ranging from 0.25 degrees per minute and 20 degrees per minute;

c. stopping the introduction of the cryogenic material into the chamber once the first target temperature is reached for at least two hours;

d. heating the material to a second target temperature ranging from 0 degrees F. and 1400 degrees F.;

e. using a second temperature rate ranging from 0.25 degrees per minute and 20 degrees per minute, and holding that second target temperature for at least fifteen minutes; and f. repeating the process at least two times, consecutively resulting in a treated material without fractures.

2. The thermal process of claim 1, wherein the first temperature rate is different from the second temperature rate to create a desired metallurgical feature in the treated material without fractures, wherein the desired metallurgical feature is selected from the group consisting of malleability, flexibility, ductility, hardness, elasticity, strength, and combinations thereof.

3. The thermal process of claim 1, wherein the first temperature rate is substantially the same as the second temperature rate.

4. The thermal process of claim 1, further consisting of the steps of:

a. introducing a cryogenic material into the thermal control apparatus to decrease the material temperature, while preventing over-stressing of the metal, to a third target temperature at a third temperature rate, wherein the third target temperature is colder than the first target temperature;

b. stopping the introduction of the cryogenic material into the chamber once the third target temperature is reached;

c. increasing the chamber temperature to a fourth target temperature; and d. increasing the material temperature to the fourth target temperature at a fourth temperature rate, resulting in the treated material without fractures.

5. The thermal process of claim 4, further consisting of the steps of:

a. introducing a cryogenic material into the thermal control apparatus to decrease the material temperature, while preventing over-stressing of the material, to a fifth target temperature at a fifth temperature rate;

b. stopping the introduction of the cryogenic material into the chamber once the fifth target temperature is reached;

c. increasing the chamber temperature to a sixth target temperature; and d. increasing the material temperature to the sixth target temperature at a sixth temperature rate, resulting in the treated material without fractures.

6. The thermal process of claim 5, further consisting of repeating the steps at least four times.

7. The thermal process of claim 1, further consisting of the step of permitting the material to soak at the first target temperature for a first period of time.

8. The thermal process of claim 1, further consisting of the step of permitting the material to soak at die second target temperature for a period of time.

9. The thermal process of claim 8, wherein the period of time ranges from 15 minutes to up to 48 hours.

10. The thermal process of claim 1, wherein the thermal process is repeated to create a second desired metallurgical feature in the treated metal without fractures, wherein the second desired metallurgical feature is selected from the group consisting of malleability, flexibility, ductility, hardness, elasticity, strength, and combinations thereof.

11. The thermal process of claim 1, wherein the thermal control apparatus further comprises a heat exchanger disposed in the chamber to provide a cryogenic vapor to a tank.

12. The thermal process of claim 11, wherein the cryogenic material is released into the heat exchanger thereby absorbing heat from the chamber into the heat exchanger forming a cryogenic vapor that fills the tank.

13. The thermal process of claim 11, wherein the cryogenic vapor is a member of the group consisting of hydrogen, nitrogen, oxygen, helium, argon, and combinations thereof.

14. The thermal proccss of claim 1, wherein the first temperature rate and the second temperature rate are determined by the mass of the material.

15. The thermal process of claim 4, wherein the third temperature rate and the fourth temperature rate are determined by the mass of the material.

16. The thermal process of claim 5, wherein the fifth temperature rate and the sixth temperature rate are determined by the mass of the material.

17. The thermal process of the claim 1, wherein the chamber is selected from the group consisting of a double-walled insulated chamber, a vacuum chamber, and a vacuum-insulated chamber.

18. The thermal process of claim 1, wherein the material is selected from the group consisting of a bronze, a cobalt, a silver, a silver alloy, a nickel, a nickel alloy, a chromium, a chromium alloy, a vanadium, a vanadium alloy, a tungsten, a tungsten alloy, a titanium, a titanium alloy, a scandium, a scandium alloy, a tin, a platinum, a palladium, a gold, a gold alloy, a plated metal, a lead, a plutonium, an uranium, a zinc, an iron, an iron alloy, a magnesium, a magnesium alloy, a gallium, a gallium arsenide, a selenium, silicon, calcium, calcium fluoride, fused silica materials, germanium, indium, indium phosphide, phosphorous and combinations thereof.

19. The thermal process of claim 1, wherein the material is a laminate.

20. The thermal process of claim 19, wherein the laminate is disposed on a member of the group consisting of a ceramic, a wood, a polymer, and combinations thereof.

21. The thermal process of claim 1, wherein the material is a ceramet.

22. The thermal process of claim 4, wherein the material is a metal carbide.

* * * * *